US005113759A

United States Patent [19]

Nihira

[11] Patent Number: 5,113,759

[45] Date of Patent: May 19, 1992

[54] LATCH MECHANISM FOR SMALL-SIZE PRINTER

[75] Inventor: Shohachi Nihira, Tokyo, Japan

[73] Assignees: Citizen Watch Co., Ltd.; Astec Inc., both of Tokyo, Japan

[21] Appl. No.: 518,807

[22] Filed: May 4, 1990

[30] Foreign Application Priority Data

May 15, 1989 [JP] Japan ..... 1-121223

[51] Int. Cl.[5] ..... B41J 1/32

[52] U.S. Cl. ..... 101/93.21; 101/93.17; 101/93.18; 400/152

[58] Field of Search ..... 101/93.17, 93.18, 93.19, 101/93.20, 93.21, 93.3, 93.36, 93.37; 400/149, 150, 152, 155.1, 156.2, 156.3, 331

[56] References Cited

U.S. PATENT DOCUMENTS

| | | | |
|---|---|---|---|
| 3,455,504 | 7/1969 | Beikufner | 101/93.21 |
| 3,874,286 | 4/1975 | Ishikawa | 101/93.18 |
| 3,878,779 | 4/1975 | Clary | 101/93.21 |
| 3,889,593 | 6/1975 | McVey | 101/93.21 |
| 3,890,894 | 6/1975 | Nihira | 101/93.18 |
| 4,328,747 | 5/1982 | Fujiwara et al. | 101/93.17 |
| 4,380,195 | 4/1983 | Hori et al. | 101/93.17 |
| 4,416,557 | 11/1983 | Arai | 101/93.21 |
| 4,760,785 | 8/1988 | Hori | 101/93.18 |

FOREIGN PATENT DOCUMENTS

| | | | |
|---|---|---|---|
| 57-32970 | 2/1982 | Japan | 101/93.21 |
| 58-140282 | 8/1983 | Japan | 101/93.17 |
| 59-89186 | 5/1984 | Japan | 101/93.18 |
| 1544756 | 4/1979 | United Kingdom | 400/156.2 |
| 2065564 | 7/1981 | United Kingdom | 400/152 |

*Primary Examiner*—Edgar S. Burr
*Assistant Examiner*—Joseph R. Keating
*Attorney, Agent, or Firm*—Koda and Androlia

[57] ABSTRACT

A latch mechanism for a small-size printer capable of performing a printing operation with a desired type on a rotatable type drum being held at a print position by impacting a hammer towards the type drum across a recording paper loaded therebetween. The latch mechanism comprises a group of type drums composed of type drums of three digits each comprising a lock groove wheel for fixing one type drum selected among three drums at a print position by one type selection operation; a group of lock levers movable between its initial non-print position and its print position, which is disposed so as to correspond to each of the type drums, and constantly biased by a lock lever spring toward the lock groove wheel to lock the type drum in a print position; and a group of lock lever holding means capable of actuating the lock lever by being attracted by an electromagnet. Thus, since the lock groove wheel of each type drum has a predetermined alignment, it is possible to select on desired type drum from a plurality of type drums by one type selection operation. By a repetition of this type selection operation, the types of plural digits can be selected by a single electromagnet.

18 Claims, 7 Drawing Sheets

LATCH MECHANISM FOR SMALL-SIZE PRINTER

BACKGROUND OF THE INVENTION

1. Field of the Invention

This invention relates to a small-size printer, and more particularly to a latch mechanism for a small-size printer which is capable of performing a printing operation with a rotatable type drum secured in a print position by impacting a hammer towards the type drum against recording paper.

2. Description of the Related Art

A small size printer is well known as an external recording means for numerical data output from such devices as a cash register or a calculator, being of relatively simple mechanical structure and capable of printing any desired characters or symbols at high speed.

This type of small size printer comprises a plurality of type drums of multiple digits, each of which has a plurality of types on its outer peripheral. Each type drum is independently and rotatively supported by a type drum shaft. In the reset state, the type drums and the type drum shaft are latched together by a constant torque clutch, so that all of the type drums are rotated with the type drum shaft at a predetermined position. Consequently, although each of the type drums rotate with the type drum shaft, when the type drum is locked, it is possible to halt a type drum at a position where the desired type on the drum comes to the print position.

To this end, each type drum has a lock groove wheel disposed adjacently to the type drum and is provided with a lock lever which comprises a lock claw on its upper end for latching the lock groove wheel. As described above, since the lock claw of the lock lever latches the lock groove wheel to stop the type drum, the apparatus is now ready for a line print operation.

That is, the lock claw of the lock lever latches a groove of a lock groove wheel which corresponds to a desired type on the type drum when the type drum comes to the predetermined print position opposite to the printing hammer. With the type drum secured in the print position, an impact operation of the hammer is performed to the type drum through a recording paper.

The existing type drum latch mechanism as described above is configurated such that, when not printing, a lock lever which is disposed on the opposite side of the printing portion formed on the outer peripheral of the type drum and is constantly biased by a lock lever spring towards the type drum is held in its initial non-print position remote from the type drum, while, at the time of type selection, the lock claw of the lock lever latches the lock groove wheel of the type drum with the aid of the spring force.

With this existing latch mechanism for small-size printers, however, there is the problem that since a latching or releasing operation of the lock lever is performed by an electromagnet provided for each of the type drums of plural digits, the space and production cost occupied by these plural electromagnets and thus the total cost increased remarkably, preventing the reduction in size and cost of the apparatus.

SUMMARY OF THE INVENTION

It is therefore an object of this invention to improve the efficiency of the electromagnets utilized in the latching portion of the type drum and to provide a drum latch mechanism for a small-size printer capable of latching a desired type drum with the least number of electromagnets.

To achieve the above mentioned object, the latch mechanism according to the present invention comprises a plurality of type drum units, each of which includes a plurality of type drums having a plurality of characters and symbols on their periphery, a type drum shaft adjacently disposed to the type drums which when latched to a type drum is rotatable to a print position of the desired type, where the input operation can take place; a plurality of lock lever units each of which includes a plurality of lock levers for locking the desired type of a type drum at its print position at the time of the print operation and for holding the type drum at its initial non-print position when not printing and is disposed so as to correspond to each type drum so that the lock lever is freely movable between the print position and the initial non-print position; a lock lever spring for constantly providing a biasing force that drives the lock lever from its initial non-print position toward a print position where the lock lever latches the type drum; a plurality of first lock lever holding means units each of which includes a plurality of first lock lever holding means for holding the lock levers in their initial non-print positions remote from the type drum when in a non-printing state and for releasing the lock lever from their initial non-print positions by being actuated downwardly; a plurality of vibration plates each of which is provided so as to actuate each of the first lock lever holding means unit; a plurality of electromagnets each of which is provided so as to actuate each of the vibration plates, and thus the lock lever holding means units and a reset bar for resetting the plurality of lock levers from their print positions to the initial non-print position after the printing operation is completed, whereby a plurality of type drums can be selected with a single electromagnet.

Namely, in the type selection process, if one electromagnet is energized for a relatively short time, a plurality of lock levers constituting a lock lever unit, are released from their initial state of being latched by a plurality of lock lever holding means, which allows the force constantly biased by the lock lever spring toward the type drum to be directly applied to the lock levers.

On the other hand, lock levers that do not engage a lock groove wheel have the opposite side to the locking side latched by the holding edge of the lock lever holding means when the lock lever holder is retracted to its initial non-print position, and so only the lock lever properly engaged with a groove wheel will be maintained in a locking state. When, the electromagnet is de-energized the lock claws of the lock levers which have not selected a groove wheel are in contact with the outer edge of their respective lock groove wheels and since the first lock lever holding means holds these lock levers in their initial non-print positions, the other type drums are not latched.

More particularly, according to the present invention, since a lock lever holder is fabricated in the form of a thin plate, when a lock claw engages with a lock groove wheel, the holding edge of the first lock lever holding means latches the locking side of the lock lever when the first lock lever holding means is retracted to its initial position.

On the other hand, lock levers that do not engage a lock groove wheel have the opposite side to the locking side latched by the holding edge of the lock lever holding means when the lock lever holder is retracted to its initial non-print position, and so only the lock lever properly engaged with a groove wheel will be maintained in a locking state.

As a result, although the electromagnet activates all of the first lock lever holding means, only one lock lever is chosen to be engaged with the type drum, and so a printing operation of a desired type is performed without fail. Once the selection of one digit is completed and the selected type drum and lock lever are latched together, the type drum unit is rotated so that a subsequent digit may be selected. The type selection operation is then carried out as before for another type drum. Thus it can be seen that only one electromagnet controlling a number of lock lever holds a need in order to select a number of digits within a type drum unit is opposite to one electromagnet for each digit in the prior art.

The foregoing and other objects, features and advantages of the invention will be apparent from the following more particular description of preferred embodiments of the invention as illustrated in the accompanying drawings.

DETAILED DESCRIPTION OF THE PREFERRED EMBODIMENTS

A preferred embodiment of the present invention will now be described hereinbelow in connection with the accompanying drawings.

Figure 1:
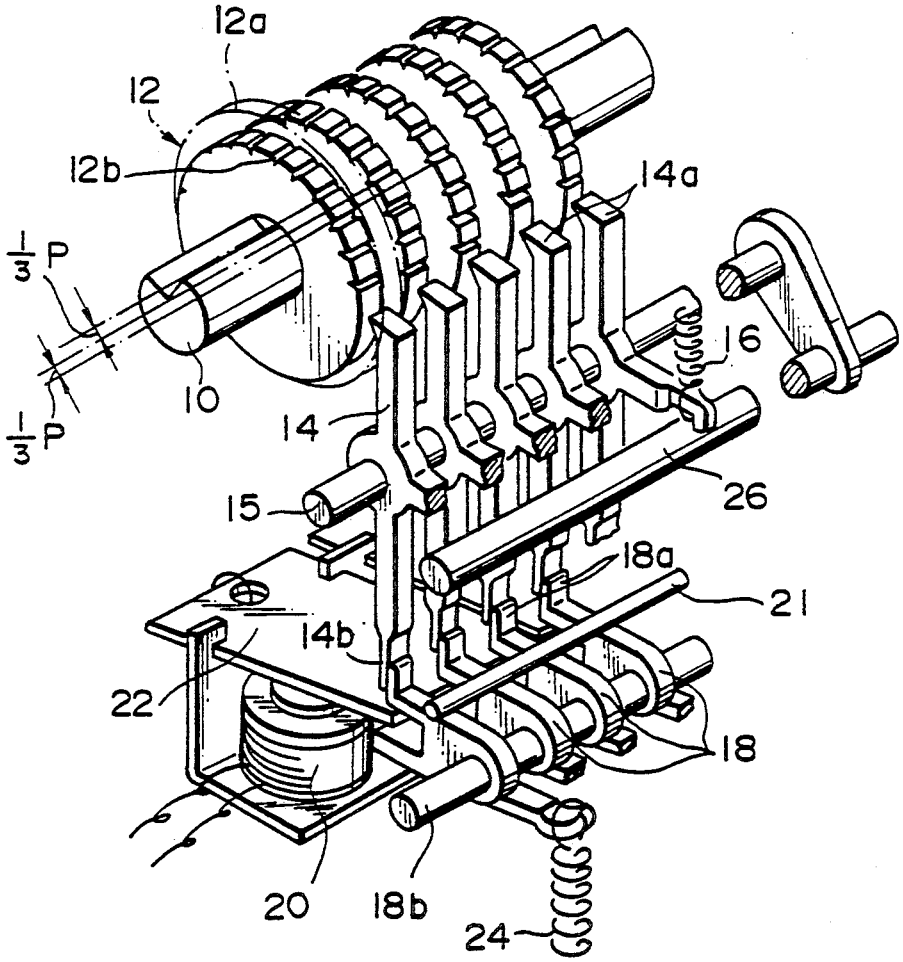
FIG. 1 is a cross sectional partially enlarged view of a latch mechanism for a small-size printer according to the preferred embodiment of the present invention.

FIG. 1 is a partial sectional view of a drum latch mechanism of the present invention. This drawing, only focus on a latch mechanism of a printer, and have been other components having nothing to do with the invention have been omitted to facilitate to comprehension of the present invention and also to simplify the explanation thereof.

In FIG. 1, a plurality of type drums 12 are supported in parallel by a type drum shaft 10 which is driven by a motor by way of a not-illustrated clutch mechanism.

Characters, symbols, and other arbitrary types are successively formed on the peripheral of each of the type drums 12 in the direction that the wheel rotates with a predetermined spacing. A latch groove wheel 12*b* is disposed adjacently to each type drum 12 to latch a desired type drum.

With this configuration, the type drums 12 comprising a font wheel 12*a* and a lock groove wheel 12*b* are adjacently and alternately disposed along the type drum shaft.

Figure 5:
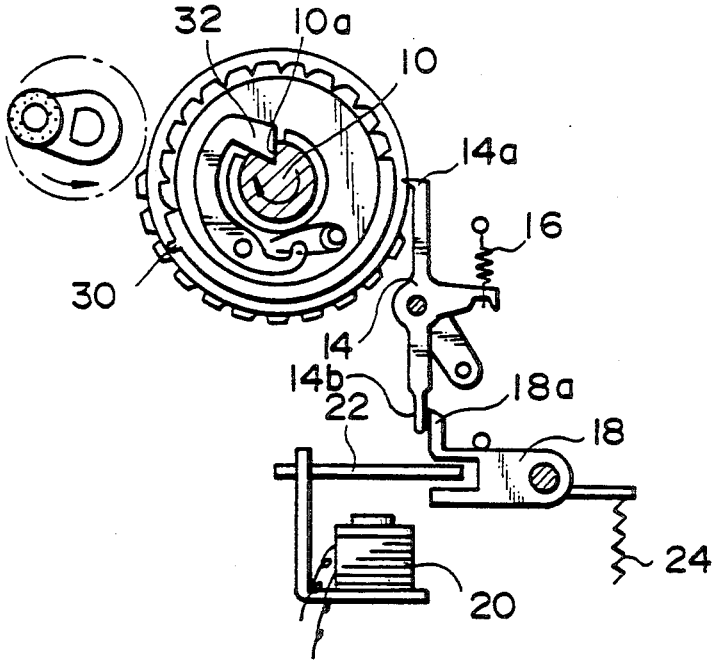
FIG. 5 is a sectional side elevation view of FIG. 1.

Moreover, each type drum 12 is rotatively supported by the type drum shaft 10 as shown in FIG. 5 with the constant torque clutch, and each type drum 12 can rotate with the type drum shaft 10 by a constant friction torque having a predetermined position therebetween.

In the type selection process, when the type drum shaft 10 is driven by a clutch, all of the type drums 12 rotate collectively, and each of the type drums is stopped and latched when a specified type on each type drum comes to a print position. After all desired types are selected, a hammer is impacted on these type drums across a recording paper disposed therebetween.

As described above, in such a small-size printer, the type drum 12 must be stopped and secured when a type to be printed on each type drum comes to a predetermined print position, so it is necessary to provide a latch mechanism for stopping and securing the type drum 12 at a position, for example, opposite to the print position at which the selected type of the type drum is printed.

In the prior art latch mechanism, the electromagnetic means employed as a driving force in the latch mechanism is respectively provided for each type drum, increasing the size and production cost of the apparatus.

The feature of the present invention is that by improving lock groove wheel on the type drum such that the grooves on all the wheels are out of phase with each other and having a structure for latching a lock lever and a lock lever holder together, only one electromagnet needs be used to select all the type drums within a unit, so reducing the number of components and thus the cost of a small printer when compared to the prior art.

In FIG. 1, a plurality of lock levers 14 each of which corresponds to each type drum are supported on a lock lever shaft 15 disposed on the outside of the type drum 12, on the opposite side from a printing portion where a not-illustrated hammer for impact is disposed.

On the upper end of the lock lever 14, a lock claw 14*a* which latches the lock groove wheel 12*b* of the type drum 12 is formed, and the lock lever 14 is constantly based by a lock lever spring 16 in the direction of the type drum 12.

The other end of the lock lever 14 is fabricated in the form of a relatively thin blade, called a lock lever holder 14*b*. A first lock lever holding means holds the lock lever holder 14*b* against the force biased by the spring.

The first lock lever holding means 18 is in the form of a U-shape as shown in FIG. 1. A vibration plate 22 which is directly actuated by an electromagnet 20 is interposed within the U shape portion of the plurality of first lock lever holding means.

The first lock lever holding means is constantly biased by a spring 24 such that the holding edge 18*a* is pushed upwards. For limiting the return movement of each first lock lever holding means from its attracted position or the print position to its released position and for maintaining it in its initial non-print condition as shown in FIG. 1, a stop means 21 is mounted on a not-illustrated frame member. Therefore, it can be understood that the direction of the movement of the lock lever holding means 18 is almost orthogonal to the direction of the movement of the lock lever 14.

Moreover, a reset lever 26 is provided in parallel to the lock lever shaft 15 for collectively resetting a plurality of lock levers to their initial non-print positions.

Another feature of the present invention is that a single electromagnet is used to control lock levers 14 which latch and hold the lock groove wheels 12*b* arranged in a group of type drums 12, each disposed in a particular position relative to each other.

Figure 3:
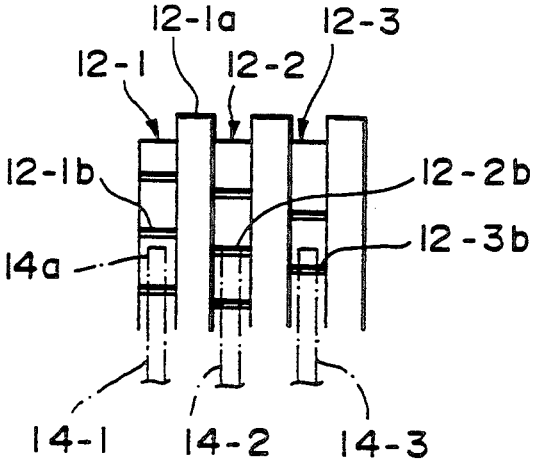
FIG. 3 is an explanatory view showing the state in which a desired a pair of lock lever and type drum is selected from a group of lock levers and type drums and the phase of one lock groove wheel is different from the other wheels.

According to the preferred embodiment of the present invention, each lock groove wheel 12-1, 12-2b and 12-3b of each type drum 12 is arranged so that none of the grooves are in alignment and non particularly so that the grooves are set one third of a groove pitch apart from each other, as shown in FIG. 3.

Operation of the latch mechanism for a small-size printer having the arrangement as described above will now be explained hereinafter.

When a not-illustrated switch is turned on to drive a type drum shaft 10, a plurality of type drums 12 mounted on the drum shaft with a constant torque clutch collectively rotate.

The moment a desired type on the type drum comes to the print position to print a character specified by the operator, the type drum 12 is stopped and held in that position. During the above described operation, the latch mechanism of the preferred embodiment performs the following series of operations.

The case where type is selected from type drums of arbitrary digits, more particularly, the selecting of a type drum 12-2 in FIG. 3 will be described hereinbelow.

Figure 2:
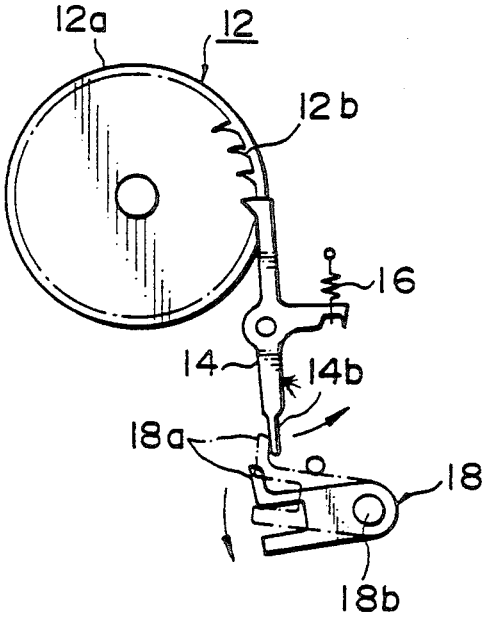
FIG. 2 is an explanatory view of the type selecting condition according to FIG. 1.

Firstly, an electromagnet 20 is energized immediately before the lock groove wheel 12-2b of the type drum 12 in FIG. 3 comes to a position to be latched by a lock claw 14-2a, so that the vibration plate 22 is attracted downwards as shown in FIG. 1 with the result that the marginal portion of the vibration plate 22 pushes the lower face of the U-shape first lock lever holding means downwards against the force biased by the lock lever spring 24. Then, the first lock lever holding means 18 moves counterclockwise around a shaft 18*b* as shown in FIG. 2.

Accordingly, as shown in FIG. 3, a plurality of lock levers 14 disposed so as to correspond to the electromagnet 20, i.e. three lock levers 14-1, 14 2, and 14-3 in FIG. 3, are released from the state of being locked by the first lock lever holding means 18, urging the lock claws 14*a* formed on a distal end of the lock levers toward the outer surface of the three corresponding type drums 12-1, 12-2, and 12-3 by the force biased by the lock lever spring 16.

As is evident from FIG. 3, although three lock claws 14-1*a*, 14-2*a*, and 14-3*a* are pressed upon the respective type drum 12, the lock claw 14-2*a* exclusively latches the lock groove wheel 12-2*b* of the type drum 12.

Figures 6A, 6B, 6C:
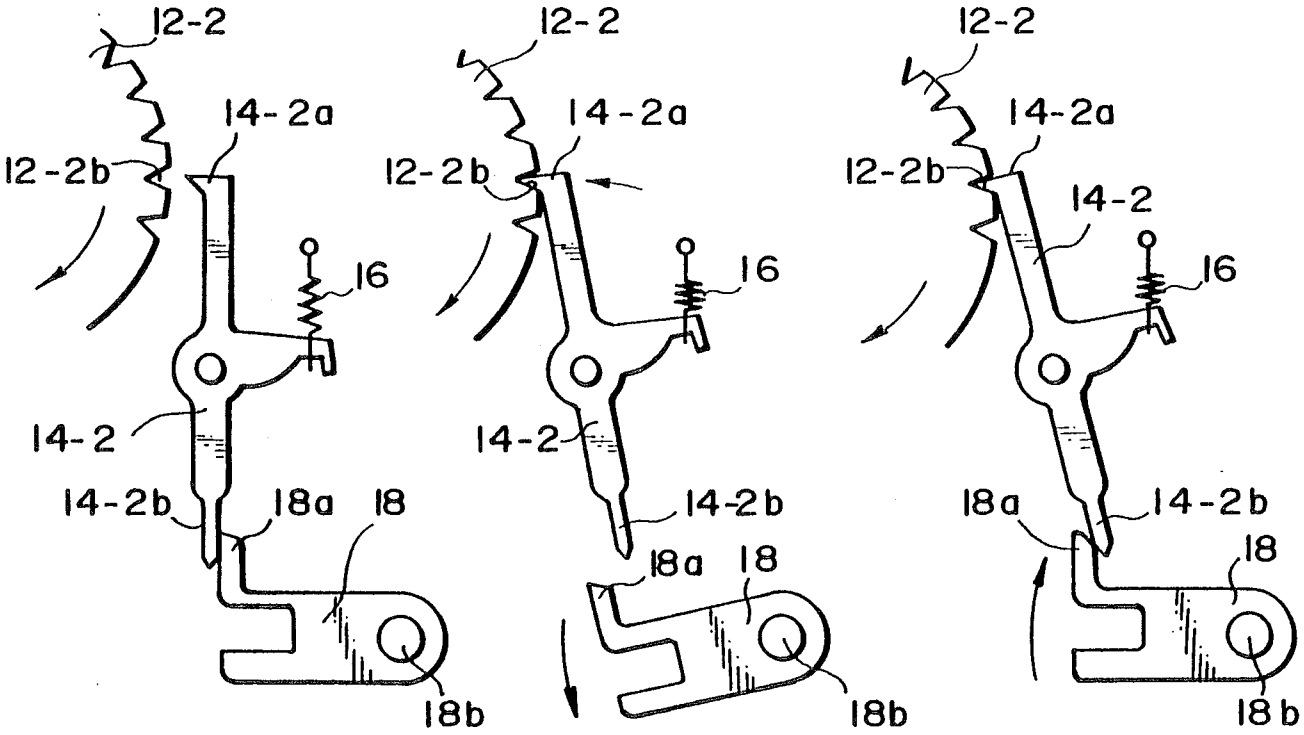
FIGS. 6A, 6B and 6C and 7A, 7B and 7C are explanatory views illustrating a latching operation of a first lock lever holding means and a lock lever.

In FIG. 6, the type selection operation of the embodiment is illustrated. In FIG. 6A, the lock claw 14-2*b* faces the lock groove wheel 12-2*b* of the type drum 12. FIG. 6*b* shows a the state when the lock claw 14-2*a* latches the lock groove wheel 12-2*b* by the rotational movement of the first lock lever holding means 18 in the direction of the arrow or counterclockwise.

The constant torque clutch composed of a groove 10*a* cut into the type drum shaft 10 and the shaft claw 32 is released from its clutched position, and the type drum 12-2*a* a type of which is selected is held still at its print position, whereas the type drum shaft 10 continues its rotation.

Thus, once the desired type of a type drum 12-2 is selected, the type drum is held stationary in its print position. That is, before the next lock claw 14-1*a* latches the lock groove wheel 12-1*b*, the electromagnet 20 is de-energized, so that the first lock lever holding means 18 returns clockwise as shown in FIG. 6C. At this time, the marginal edge 18*a* or the holding edge locks the left side or the locking side of the lock lever holder 14-2*b* of the lock lever 14 so that the first lock lever holding means 18 can maintain the holding state without colliding with the lock lever 14 when the first lock lever holding means returns to its initial position.

As a result, the other end of the lock lever 14 whose lock claw latches the lock groove wheel 12*b* of the type drum 12 is positioned in the reverse location relative to the holding edge 18*a* of the first lock lever holding means 18 as shown by a chain-dot-line in FIG. 2 when the type selection operation is completed. The first lock lever holding means 18 maintains the state where the desired type is selected being engaged with the left side or a locking side of the lock lever 14 even when the first lock lever holding means 18 is retracted as shown by a chain line.

On the other hand, the attraction of the vibration plate causes the release of the other two lock levers 14 from their initial non-print positions int eh same manner as mentioned above.

The other two lock levers, however, are consequently retracted to their initial non-print positions without latching the lock groove wheels. The retracting operation of these lock levers will now be described in connection with FIG. 7.

Figure 7A:
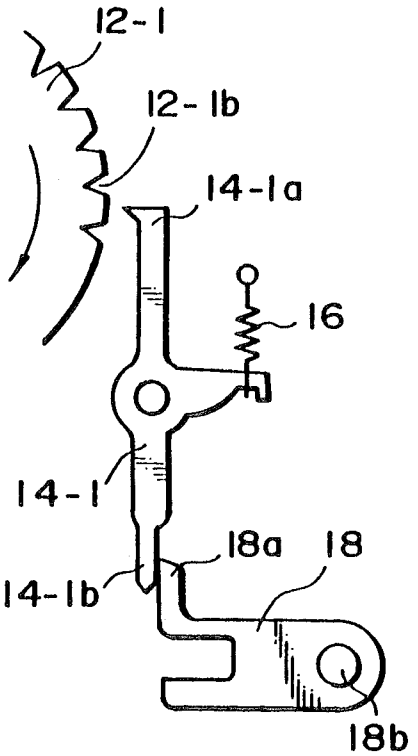
Figure 7B:
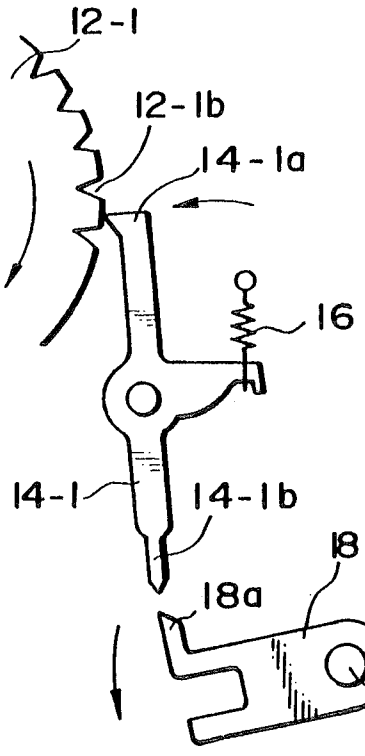

In FIG. 7A, the lock claw 14-1*a* faces the outer edge of the lock groove wheel of the font wheel 12-1. Accordingly, even though the first lock lever holding means 18 moves counterclockwise as shown in FIG. 7B, the lock claw 14-1*a* is pressed upon the outer edge of the groove wheel, failing to latch it.

Figure 7C:
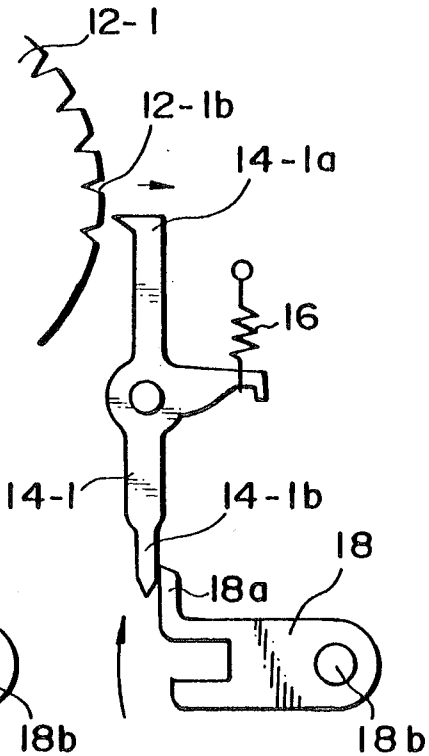
Figure 8:
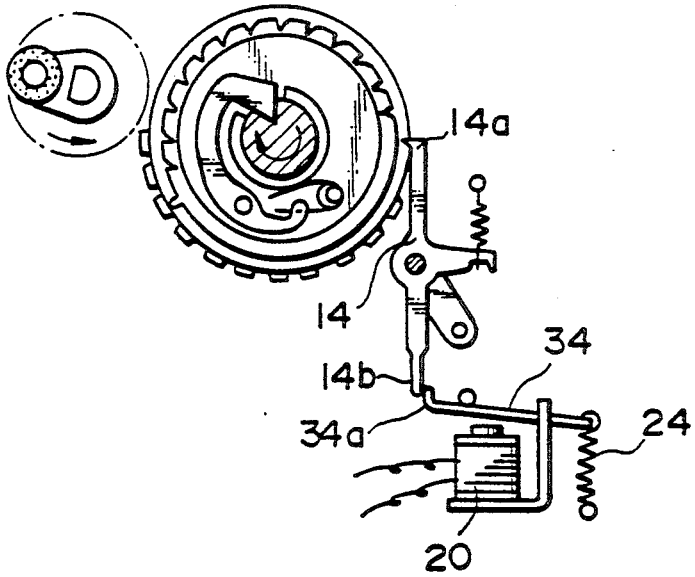
FIG. 8 is a second preferred embodiment of the present invention.

Thus, the electromagnet 20 is de-energized before the lock claw 14-1*a* latches a lock groove 12-1*b*, retracting the first lock lever holding means 18 clockwise as shown in FIG. 7C by the force biased by the spring 24. As is apparent from the embodiment, the holding edge 18*a* of the first lock lever holding means 18 holds the right side or the holding side of the lock lever holder 14-1*b* of the lock lever 14-1, slightly moving the lock lever 14-1 clockwise to maintain it in its initial nonprint position spaced away from the type drum 12-1.

Therefore, according to the present invention, it is possible to control the position of the lock lever between the holding position, right side of the end holder and the locking position, left side thereof when the first lock lever holding means returns depending on whether or not the lock claw latches the lock groove wheel of the type drum.

As has been described above, only one type drum is latched among the type drums of three digits by a single electromagnet 20, for example, the type drum 12-2, whereas the other two drums, 12 1 and 12 3 continue their rotation with the type drum shaft 10.

In the same manner, as has not been fully explained in the foregoing description, the type selection operation is performed on the other groups of type drum. When the type selection is completed for all groups of type drum, all selected types are impacted on a recording sheet of paper at one time by the printing mechanism as previously mentioned.

As shown in FIG. 5, after the type selection operation and printing operation are completed, the electromagnet 20 is energized to attract the vibration plate 22 to its attracted position. At that time, a reset bar 26 is moved clockwise to reset the position of the lock levers 14 and the first lock lever holding means 18 to their initial positions.

Thus, the type drums are released from their latched state, and they are rotated with the type drum shaft 10 friction-connected until they are stopped when protruding portion for reset 30 contacts with a claw of the clutch 14*a* of the lock lever 14.

Thereafter, although the clutch claw 32 latches the V-shaped ditch 10*a* of the type drum shaft 10, the reset bar 26 dislocates the lock lever 14 from the protruding portion for reset 30 momentarily before the claw of the clutch latches the ditch.

The type drum shaft 10 halts its rotation after it has rotated a little further forward to be reset to its initial position.

Figure 4:
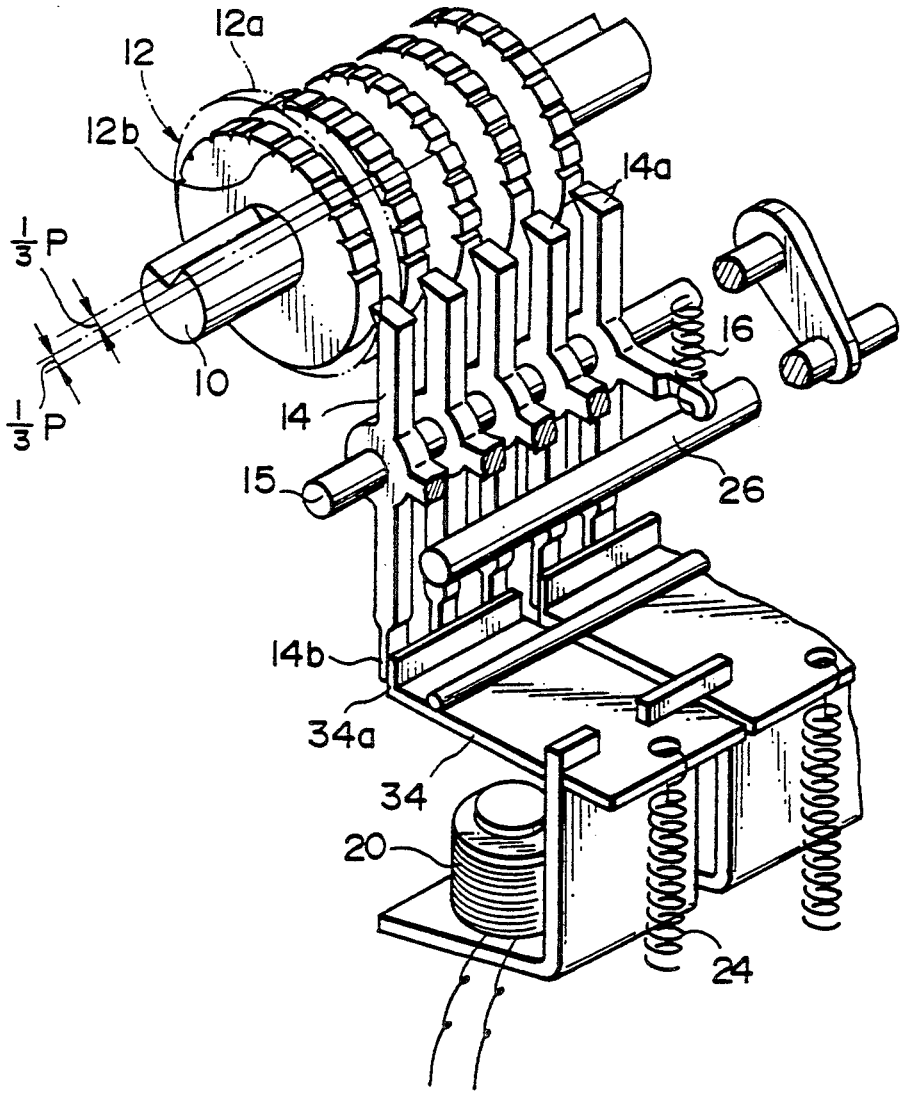
FIG. 4 is a second preferred embodiment of the present invention.

In FIG. 4, a second preferred embodiment of the present invention is illustrated. In FIG. 4, a second lock lever holding means 34 serves as an actuator for holding a group of lock levers 14 in their print position or non-print position by the magnetic force of attraction exerted by a single electromagnet in the same manner as described above. With this arrangement, since the second lock lever holding means functions as both the vibration means and the lock lever holding means, the same effect obtained by the first embodiment can be achieved with a smaller number of components.

As described above, according to the present invention, since lock groove wheel in a type drum is arranged with its grooves on a pitch different form other wheels in a group and also the lock levers are disposed so that each lock lever is independently movable by a single electromagnet, it becomes possible to reduce the number of electromagnets necessary to perform a type selection of a plurality of type drums to minimum and to provide a low cost small-size printer.

What is claimed is:

1. A latch mechanism for a small-size printer capable of performing a printing operation with a desired type on a rotatably type drum secured at a print position by impacting a hammer towards the type drum across a recording paper loaded therebetween, said latch mechanism comprising:

a type drum shaft;

a plurality of type drum units, each of which include lock groove wheels and font wheels disposed in spaced relation to each other, said font wheels having a plurality of characters and symbols on their outer peripheral, and rotating with said type drum shaft and means to latch said font wheels to position a desired type for printing;

a plurality of lock lever units, each of which includes a plurality of lock lever means for latching a desired lock groove wheel in the print position when performing an printing operation and for latching a font wheel at said font wheel's initial non-print position, and disposed so as to correspond to each type drum, and movable between a print position and an initial non-print position;

a lock lever spring means for constantly providing a biasing force that biases said lock lever means from said lock lever means initial non-print position toward a print position where said lock lever means latches said type drum;

a plurality of lock lever holding means units, each of which includes a plurality of lock lever holding means with a holding side and a locking side for respectively holding said lock means in their initial non-print positions remote form said font wheels in a non-printing state and for releasing said lock lever means from their initial nonprint positions by being actuated downwardly;

a plurality of vibration plates, each of which is provided so as to correspond to each of said lock lever holding means units for actuating said lock lever holding means;

a plurality of electromagnets, each of which is provided so as to correspond to and activate one of said vibration plates; and a reset bar means for resetting said plurality of lock levers means from their print positions to the initial non-print positions after a printing operation is completed.

2. A latch mechanism according to claim 1, wherein said lock groove wheels have grooves arranged to correspond to each character formed on said font wheels.

3. A latch mechanism according to claim 2, wherein each lock groove wheel of said type drum unit has a predetermined phase to be shifted from other lock groove wheels.

4. A latch mechanism according to claim 3, wherein said phase of said lock groove is set at one third pitch.

5. A latch mechanism according to claim 1, wherein said lock lever holding means includes a holding edge means at one end, an upper marginal end of said lock lever holding means extends upwardly having an oblique edge, for locking said lock lever means while said lock lever means latches the lock groove wheel and for holding the lock lever means in its initial non-print position against a force being biased by said lock lever spring.

6. A latch mechanism according to claim 1, wherein said lock lever means includes a lock claw means on its upper end for latching said lock groove wheel of said type drum unit and a holding edge means on its lower end for locking with said lock lever holding means to hold said lock lever means in its initial non-print position and for holding said lock lever means in its print position, whereby said holding edge of said lock lever holding means locks said locking side of said lock lever holder means while said lock lever means latches said lock groove wheel, whereas said holding edge means of said lock lever holding means holds said holding side of said lock lever means to maintain it in the initial non-print position thereof.

7. A latch mechanism according to claim 6, wherein said holding edge means of said lock lever means is a relatively thin blade.

8. A latch mechanism according to claim 1, wherein each of said plurality of said electromagnets is provided for each of a plurality of groups of lock lever holding means wherein each group is composed of at least three lock lever holding means.

9. A latch mechanism according to claim 1, further comprising a stoop means disposed closely in contact with the upper surface of said lock lever holding means unit for limiting return movement of each lock lever holding means.

10. A latch mechanism for a small-size printer capable of performing a printing operation with a desired type on a rotatable type drum secured at a print position by impacting a hammer towards the type drum across a recording paper loaded therebetween, said latch mechanism comprising:

a type drum shaft;

a plurality of type drum units, each of which includes lock groove wheels and font wheels disposed in spaced relation to each other, said font wheels having a plurality of characters and symbols on their outer peripheral, and rotating with said type drum shaft and means to latch said font wheels to position a desired type for printing;

a plurality of lock lever units, each of which includes a plurality of lock lever means for latching a desired lock groove wheel in the print position when performing a printing operation and for latching a font wheel at said font wheel's initial non-print position, and disposed so as to correspond to each type drum, and movable between a print position and an initial non-print position;

a lock lever spring means for constantly providing a biasing force that biases said lock lever means from said lock lever means initial non-print position toward a print position where said lock lever means latches said type drum;

a plurality of lock lever holding means units, each of which includes a lock lever holding means which is a single plate with a holding side and a locking side for respectively holding said lock lever means in their initial non-print position remote from said font wheels and for releasing said lock lever means from the non-print position by being attracted downwardly;

a plurality of electromagnets, each of which is provided so as to correspond to and one of said lock lever holding means; and a reset bar means for resetting said plurality of lock lever means from their print position to the initial non-print position after a printing operation is completed.

11. A latch mechanism according to claim 10, wherein said lock groove wheels have grooves arranged to correspond to each character formed on said font wheels.

12. A latch mechanism according to claim 11, wherein each lock groove wheel of said type drum unit has a predetermined phase to be shifted from other lock groove wheels.

13. A latch mechanism according to claim 12, wherein said phase of said lock groove is set at one third pitch.

14. A latch mechanism according to claim 10, wherein said lock lever holding means includes a holding edge means, an upper marginal end of said lock lever holding means extends upwardly having an oblique edge, foı locking said lock lever means while said lock lever means latches said lock groove and for holding the lock lever means in its initial non-print position against a force being biased by said lock lever spring.

15. A latch mechanism according to claim 10, wherein said lock lever means includes a lock claw means on its upper end for latching said lock groove wheel of said type drum unit and a holding edge means on its lower end for locking with said lock lever holding means to hold said lock lever means in its initial non-print position or for holding said lock lever means in its print position, whereby said holding edge means of said lock lever holder means locks said locking side of said lock lever holder means when said lock latches said lock groove wheel, whereas said holding edge means of said lock lever holding means holds said holding side of said lock lever means to maintain said lock lever means in the initial non-print position thereof.

16. A latch mechanism according to claim 15, wherein said holding edge means of said lock lever means is a relatively thin blade.

17. A latch mechanism according to claim 10, wherein each of said plurality of said electromagnets is provided for each of a plurality of groups of lock lever holding means wherein each group is composed of at least three lock lever holding means.

18. A latch mechanism according to claim 10, further comprising a stop means disposed closely in contact with the upper surface of said lock lever holding means unit for limiting return movement of said lock lever holding means.

* * * * *